US011234541B2

(12) United States Patent
Johnson

(10) Patent No.: US 11,234,541 B2
(45) Date of Patent: Feb. 1, 2022

(54) MULTIPLE-COMPARTMENT PITCHER

(71) Applicant: Robert R. J. Johnson, Belle River (CA)

(72) Inventor: Robert R. J. Johnson, Belle River (CA)

( * ) Notice: Subject to any disclaimer, the term of this patent is extended or adjusted under 35 U.S.C. 154(b) by 0 days.

(21) Appl. No.: 16/869,160

(22) Filed: May 7, 2020

(65) Prior Publication Data

US 2020/0367674 A1 Nov. 26, 2020

Related U.S. Application Data

(60) Provisional application No. 62/852,493, filed on May 24, 2019.

(51) Int. Cl.
*A47G 19/12* (2006.01)

(52) U.S. Cl.
CPC ..... *A47G 19/12* (2013.01); *A47G 2019/122* (2013.01)

(58) Field of Classification Search
CPC .. A47G 19/12; A47G 19/14; A47G 2019/122; A47G 19/127
See application file for complete search history.

(56) References Cited

U.S. PATENT DOCUMENTS 3,205,678 A 9/1965 Stoner
4,608,837 A * 9/1986 Hickey ..... B65D 25/04 62/390
5,265,767 A * 11/1993 Gustafson ..... A47G 19/12 222/144.5
5,328,050 A * 7/1994 Hyatt ..... B67D 3/0022 220/506
5,487,486 A 1/1996 Meneo
5,678,472 A * 10/1997 Millman ..... A47G 19/14 99/279
6,497,344 B1 12/2002 Dial
6,755,328 B1 6/2004 Franco
(Continued)

FOREIGN PATENT DOCUMENTS

CN 202063412 U 7/2011

OTHER PUBLICATIONS

PITCHER * EZ2Serve Dual Chamber Pitcher clear; available online at: https://www.ebay.co.uk/itm/PITCHER-EZ2Serve-DUAL-CHAMBER-PITCHER-Clear-/181781467249; accessed: May 3, 2019.
(Continued)

*Primary Examiner* — J C Jacyna
(74) *Attorney, Agent, or Firm* — Wood, Phillips, Katz, Clark & Mortimer

(57) ABSTRACT

Provided herein is a multiple-compartment pitcher. The pitcher in one embodiment comprises openings for downspouts arranged in a bottom portion of the pitcher body, and in which each opening communicates with one of a respective compartment. A lid is provided with openings providing for fluid communication with each compartment to allow venting of air, thereby facilitating discharge of liquid contents from a compartment when a downspout is opened. In another embodiment, the pitcher has spouts formed in the top portion of the pitcher body and in which the spouts are arranged at an angle relate to the handle of the pitcher to facilitate ease of pouring.

11 Claims, 17 Drawing Sheets

(56) References Cited

U.S. PATENT DOCUMENTS

| | | | | |
|---|---|---|---|---|
| 6,989,168 | B2 | 1/2006 | Fahey | |
| 7,269,969 | B2 * | 9/2007 | Strickland | B65D 25/282 220/592.16 |
| 7,306,095 | B1 | 12/2007 | Bourque et al. | |
| 9,872,587 | B1 | 1/2018 | Dipaolo et al. | |
| 9,884,753 | B1 * | 2/2018 | Juarez | B67D 3/0061 |
| 10,544,030 | B2 | 1/2020 | Ewing | |
| 2008/0110899 | A1 * | 5/2008 | Gustafson | A47G 19/14 220/553 |
| 2015/0144516 | A1 | 5/2015 | Shamoon | |
| 2016/0114942 | A1 * | 4/2016 | Mussio | B65D 43/0222 222/144.5 |

OTHER PUBLICATIONS

Mind Reader BEVD6C-CLR Dispenser, 3 Tier Stackable Drink Holder with Lids, Clear Acrylic 6 Compartment Beverage Display with Spigots, One Size; available online at: https://www.amazon.com/Mind-Reader-BEVD6C-CLR-Dispenser-Compartment/dp/B07HZP3V31; accessed: May 26, 2020.

* cited by examiner

MULTIPLE-COMPARTMENT PITCHER

CROSS-REFERENCE TO RELATED APPLICATIONS

The present application claims priority from U.S. Application Ser. No. 62/852,493 filed May 24, 2019, the contents of which are incorporated herein by reference.

TECHNICAL FIELD

The present disclosure relates to a pitcher for containing two or more liquids and/or ice in separate compartments.

BACKGROUND

Most pitcher designs have one spout for pouring a liquid. The pitcher spout is typically at 180 degrees from the handle and allows the user to grasp the handle and pour liquid by tilting the pitcher forward. However, it is often desirable to serve more than one beverage. In this case, two pitchers must be used for the different beverages. This can take up significant room in a fridge compartment. Moreover, it is often desirable to cool a beverage with ice. However, ice floating or contained within a beverage can make pouring the beverage problematic and may cause spillage as the ice falls into a glass or tumbler. Further, when the ice melts, the beverage becomes more dilute, which could negatively impact its flavor.

U.S. Pat. No. 9,872,587 describes a beverage container for holding coffee, referred to as a carafe. The dual-chamber carafe has two separate storage chambers for holding two different beverages such as regular coffee and decaffeinated coffee. The spouts are at 180 degrees from one another and at 90 degrees to the handle. The lid has a valve arrangement that allows the user to select which of the separated storage chambers liquids will be drawn from. Further, a dual chamber pitcher is marketed as "EZ2Serve Dual Chamber Pitcher" and has spouts that are 180 degrees from one another and at 90 degrees to the handle.

Large beverage dispensers with multiple compartments are also known and often include spigots, faucets, taps or nozzles to dispense liquid from a bottom portion of each compartment. Each compartment may be stacked one on top of the other. However, such dispensers often include a base on which the dispenser rests to raise the container sufficiently from a supporting surface so a glass or tumbler can be accommodated under the spigot or nozzle. Thus, dispensers of this type are large and tilting of the dispenser to eliminate remaining liquid in a compartment may prove challenging. Further, with such designs, dispensing of liquid from each compartment may be inconvenient unless venting is provided by untightening or removing one or more lids of each compartment.

U.S. Pat. No. 10,544,030 describes a four-compartment juice container. Liquid contents are dispensed through a bottom portion of the container via an integrated valve actuated dispensing mechanism. However, such arrangement requires numerous complicated parts that may not facilitate ease of cleaning. Further, it may prove difficult or inconvenient to empty each compartment of liquid contents completely.

The present disclosure seeks to address, ameliorate and/or avoid one of more of such disadvantages or provide useful alternatives to known designs.

SUMMARY

Provided herein is a multiple-compartment pitcher for holding one or more liquids and/or ice in separate compartments.

In one embodiment, there is provided a pitcher comprising two, three or more compartments, each having openings in communication with the bottom portion of a respective compartment. Each opening receives a downspout (e.g., faucets, taps or spigots) through which flows liquid from a respective compartment and is actuated between a closed and an open position by a user. The design has advantages over existing multiple compartment beverage containers with downspouts. Such containers may need to be tipped manually to remove residual liquid contents by grasping both hands around opposing side walls of the container, but this is often not practical for heavy, multiple compartment containers. To address this problem, the pitcher described herein comprises a handle that allows it to be tilted to remove last remaining amounts of beverage from the bottom of each compartment through each downspout. In addition, the pitcher disclosed herein may be tapered so that its cross-sectional area decreases from the top of the pitcher to the bottom, further facilitating removal of the last amounts of beverage from each compartment due to the smaller volume at the bottom portion of the pitcher. Yet a further advantage is the provision of venting openings in the lid. Such openings are positioned in the lid so that air can flow out from each respective compartment, thereby facilitating discharge of the liquid contents of each compartment independently of the other.

In another aspect, the disclosure provides a multiple-compartment pitcher that has spouts formed in the top of the pitcher body and in which the compartments and spouts are arranged to facilitate the pouring of liquid from each compartment by a user. As discussed, prior pitcher designs provide spouts at 180 degrees from one another and at respective right angles to a handle. However, such a design makes the pouring of each beverage from the separate compartments cumbersome. The handle must be grasped and the spout positioned over a glass or tumbler. The pitcher must then be tilted to the left or right for pouring of the beverage, and in doing so, the wrist must be twisted sideways. The present pitcher design, according to an alternate embodiment, has spouts that are at least 110 degrees from a handle. The pitcher can be tipped forward or at a slight angle with respect to the handle to dispense the beverage from a given compartment. In this manner, the handle can be grasped and the force used to tilt the pitcher forward is exerted by the forearm and elbow rather than solely by the action of the wrist. Not only is the wrist of a user subject to less strain, but the pitcher can be tilted and liquid dispensed in a single smooth movement.

DETAILED DESCRIPTION

The following detailed description of embodiments is merely exemplary and should not be construed as limiting to the scope of the invention.

Figure 1:
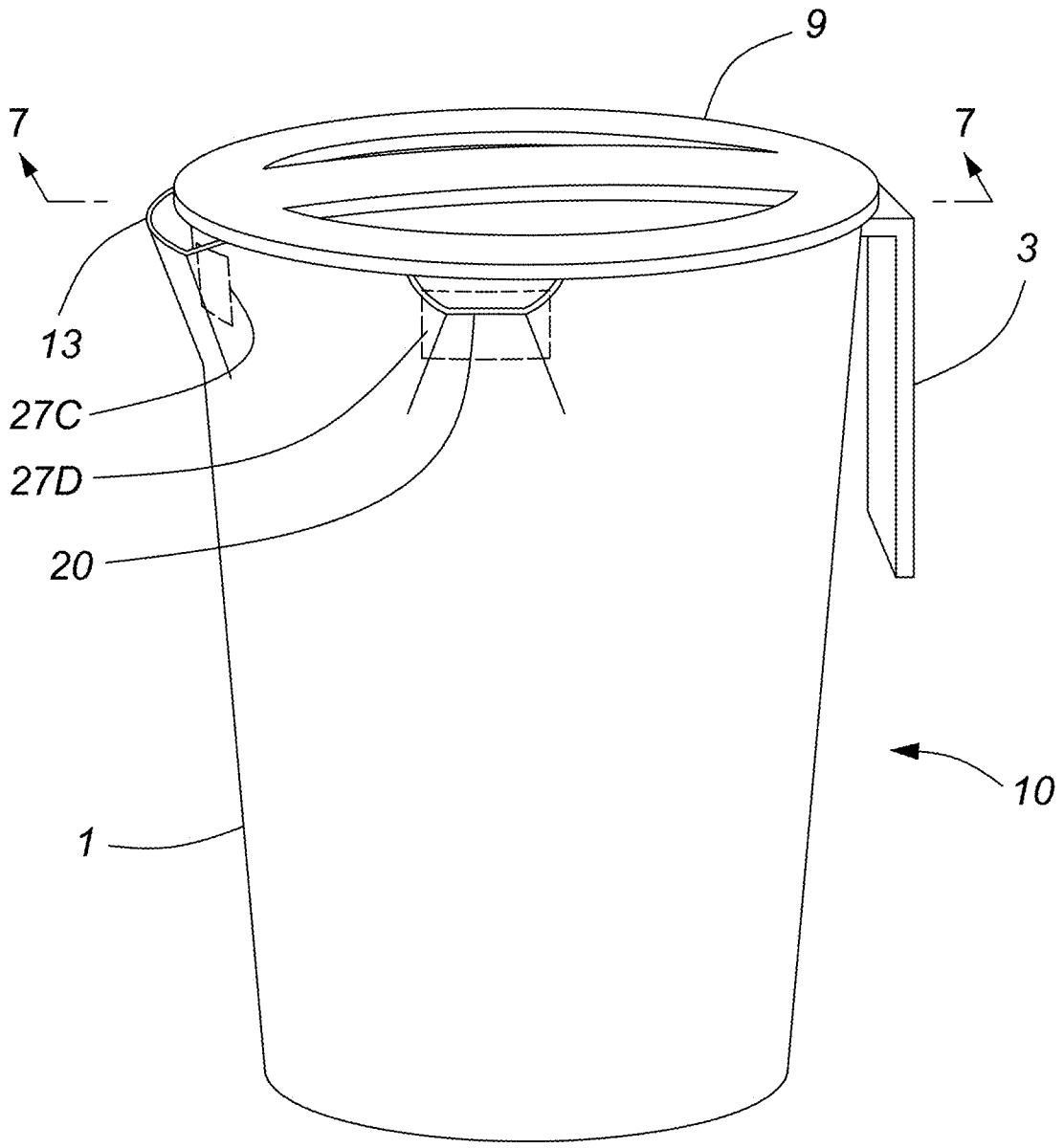
FIG. 1 is a three-dimensional drawing of a pitcher having two spouts and two respective compartments according to a first embodiment.

Reference is made to FIG. 1, which depicts a first embodiment of the disclosure. The first embodiment depicted is of a pitcher 10 having two compartments described below. As shown in FIG. 1, the pitcher 10 has a pitcher body 1 and a top cover 9 that fits over the opening of the pitcher body 1. A first spout 13 and a second spout 20 are formed in first compartment 14 and second compartment 16, respectively. A handle 3 is formed in pitcher body 1 and is located at a position of 180 degrees from the first spout 13.

Figure 2:
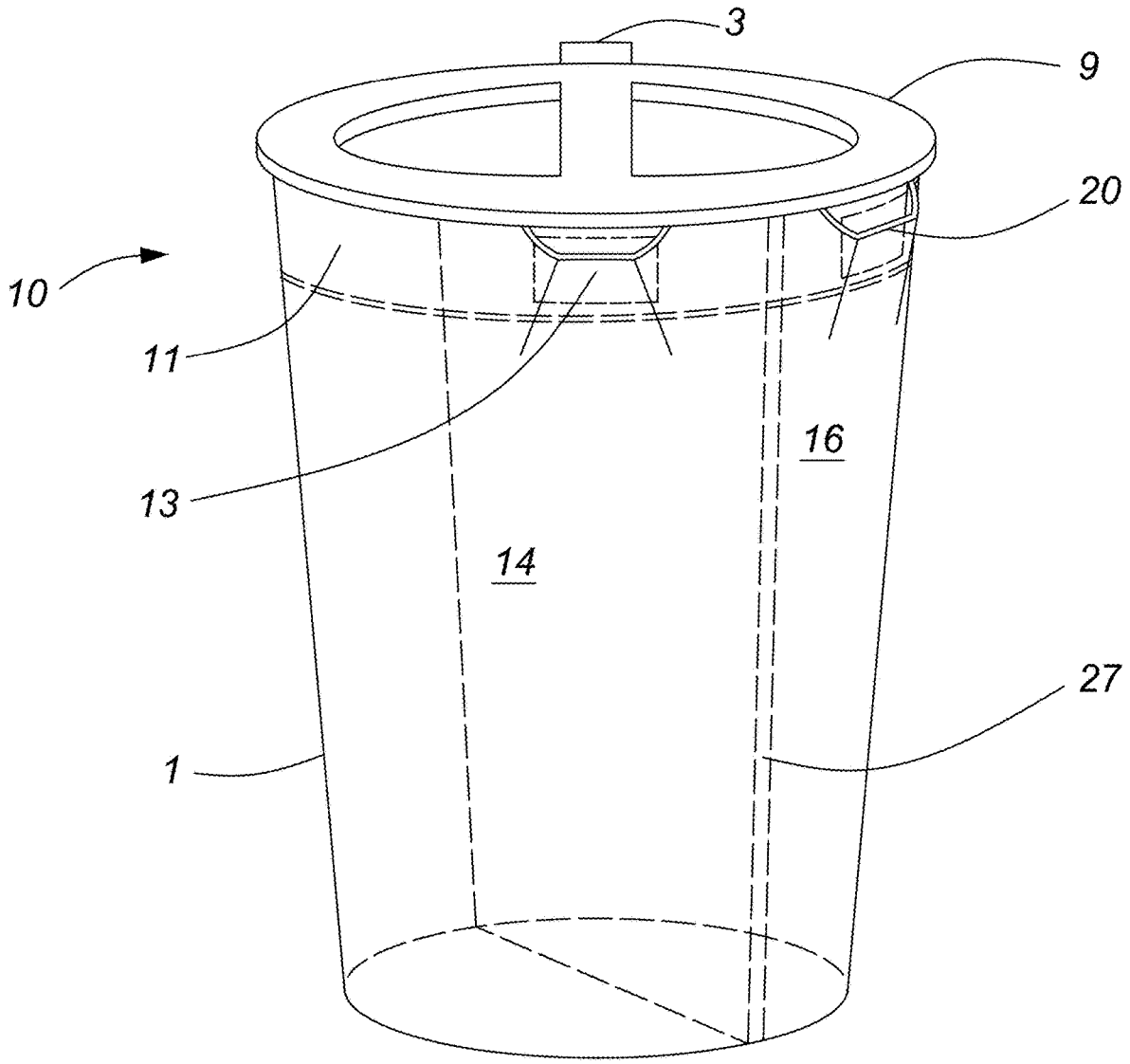
FIG. 2 is another three-dimensional drawing of a pitcher having two spouts as seen from a different angle.

As shown in FIG. 2, the first compartment 14 and second compartment 16 are separated by a divider wall 27 that separates the pitcher body 1 into the two compartments. Each of the compartments 14, 16 is capable of holding separate liquids, or alternatively, one of the compartments holds ice and the other a liquid. When the pitcher 10 is in use, a liquid contained within the first compartment 14 or the second compartment 16 flows out of the pitcher 10 through the first spout 13 or second spout 20, as described further below. The spouts and corresponding openings, when in open positions, are large enough to support the flow of sufficient liquid from a respective compartment in the pitcher 10 to a glass or cup when the pitcher 10 is tilted forward. Generally, the spouts and openings thereof are of standard design.

Figure 3:
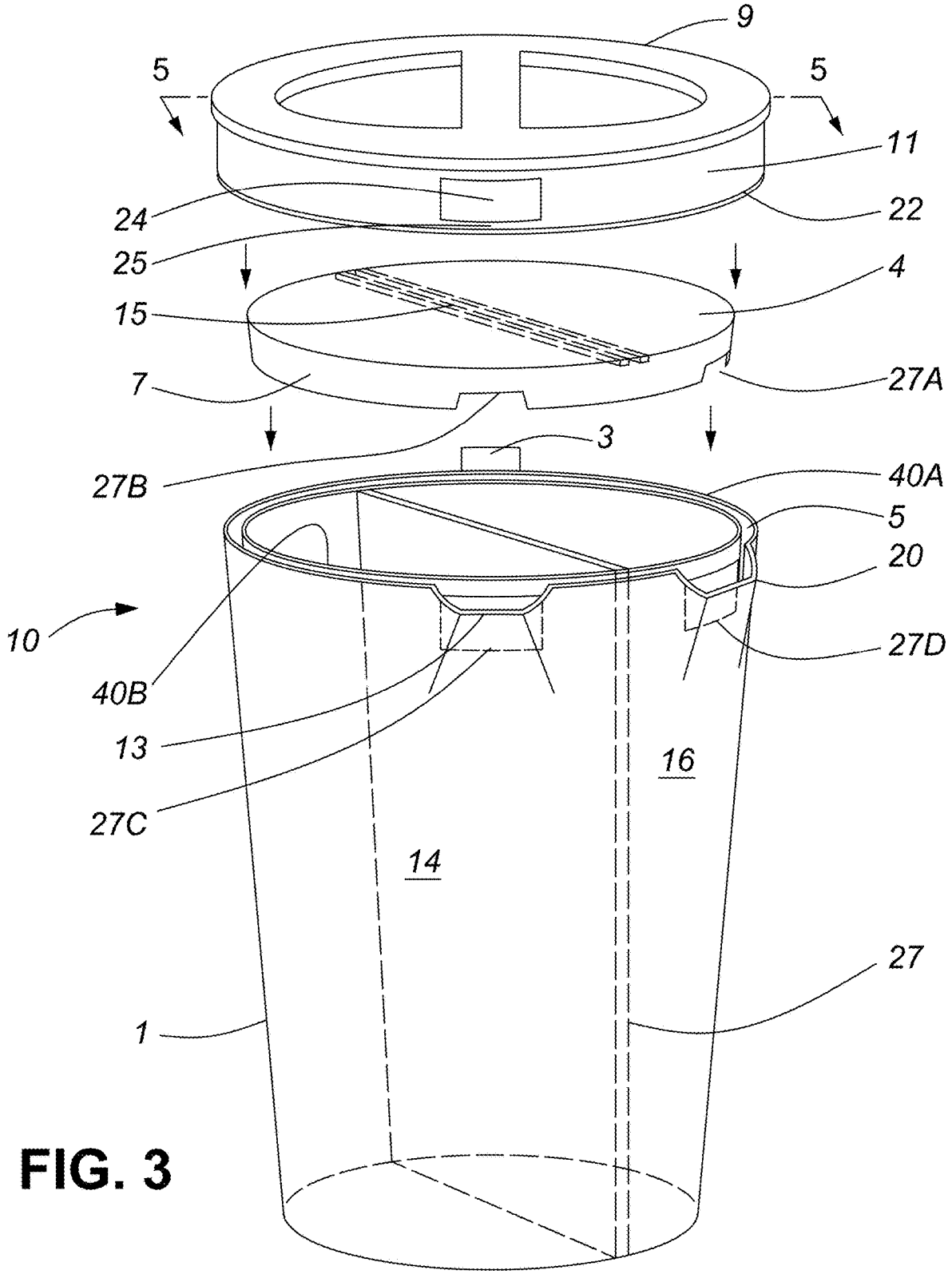
FIG. 3 is an exploded view of the two compartment pitcher, showing a top cover and a lid that fit on top of the pitcher opening as described herein.

FIG. 3 is an exploded view of the two-compartment pitcher 10. As shown in the drawings, the pitcher 10 has a top cover 9, which has a flange 11 and an opening 24 formed in the flange 11. Optionally, the top cover 9 has an annular gasket 22 at the bottom portion of the flange for sealing engagement with the inner surface of the pitcher body 1. The top cover 9 fits over a lid 4. The lid 4 has a set of ribs 15 formed on its internal surface for receiving and forming a sealing fit with the wall 27 that divides the two compartments (see also FIG. 4B). The lid 4 also has notched region 27A and notched region 27B for alignment with corresponding openings 27C and 27D formed in an inner wall 40B forming groove 5 of the pitcher body (see also FIG. 5).

Figure 4A:
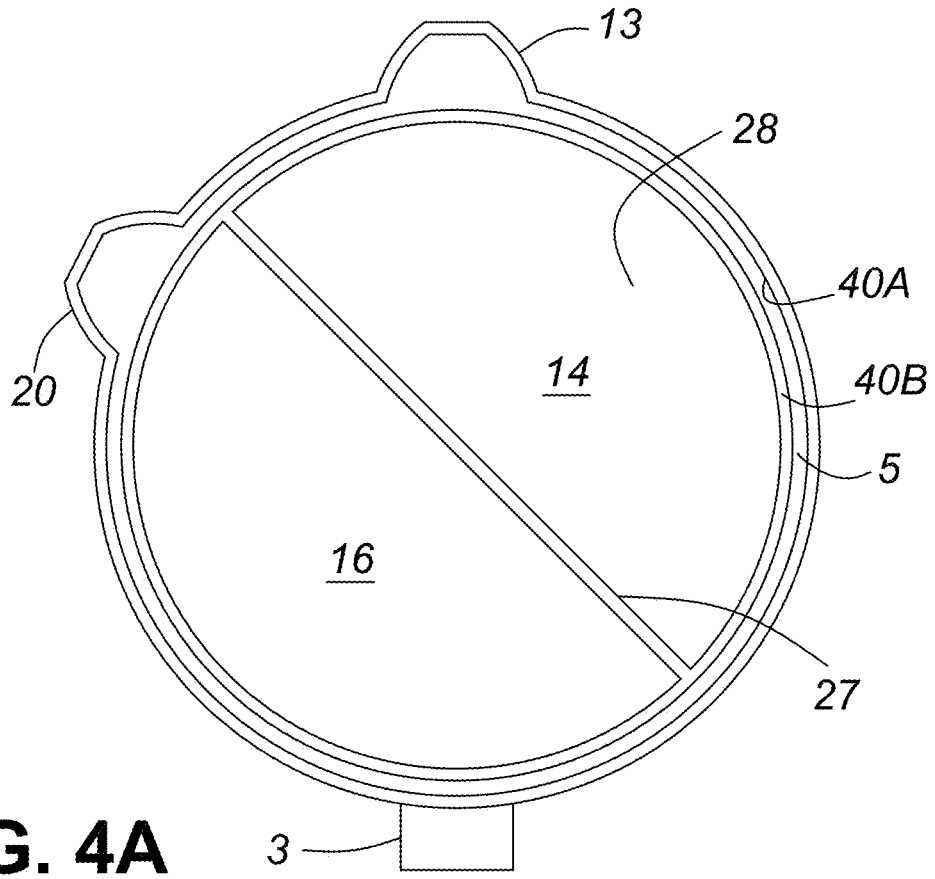
FIG. 4A is a top plan view of the two-compartment pitcher body.
Figure 4B:
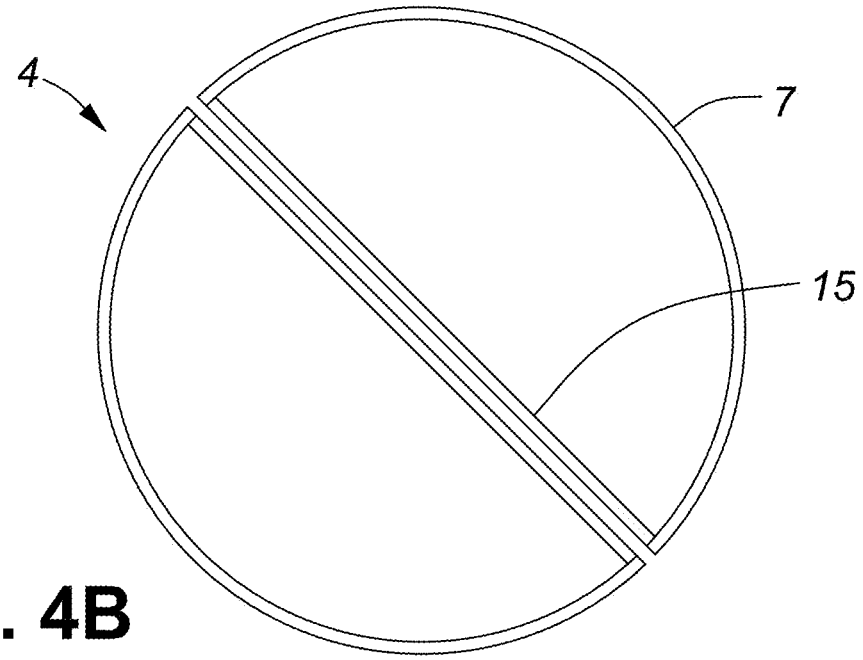
FIG. 4B is a bottom plan view of the lid for the two-compartment pitcher body.
Figure 6A:
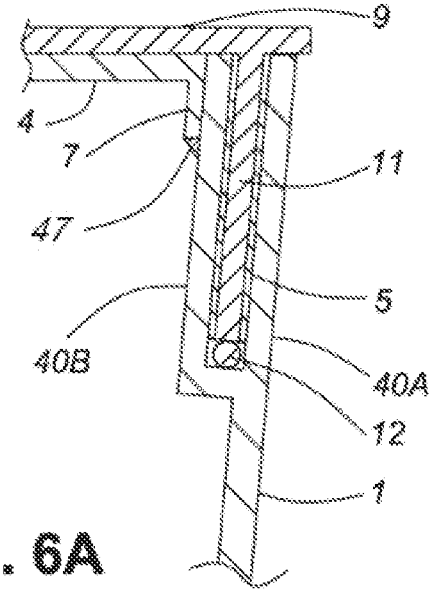
FIG. 6A is a partial view of the pitcher of FIG. 5 shown in cross-section when the top cover and lid are fit into the pitcher opening at a location between spout openings.

FIG. 4A shows a view of FIG. 3 as seen from the top of the pitcher body 1 (top plan view). In particular, FIG. 4A shows a groove 5 formed in the pitcher body 1 bounded by an outer wall 40A and the inner wall 40B that defines the groove 5. FIG. 4B shows a bottom view of lid 4 as depicted in FIG. 3. As shown in FIG. 4B, the set of ribs 15 are configured to engage with the top portion of wall 27 when the lid is placed in position on the pitcher opening. The lid 4 also has a lid lip 7 formed around the circumference of the lid 4. When the lid 4 is positioned over the pitcher opening, the lid lip 7 forms a tight fit against the inner wall of the pitcher body 1. Optionally, the lid lip 7 has an annular gasket at its lower edge shown as 47 in FIG. 6A.

Figure 5:
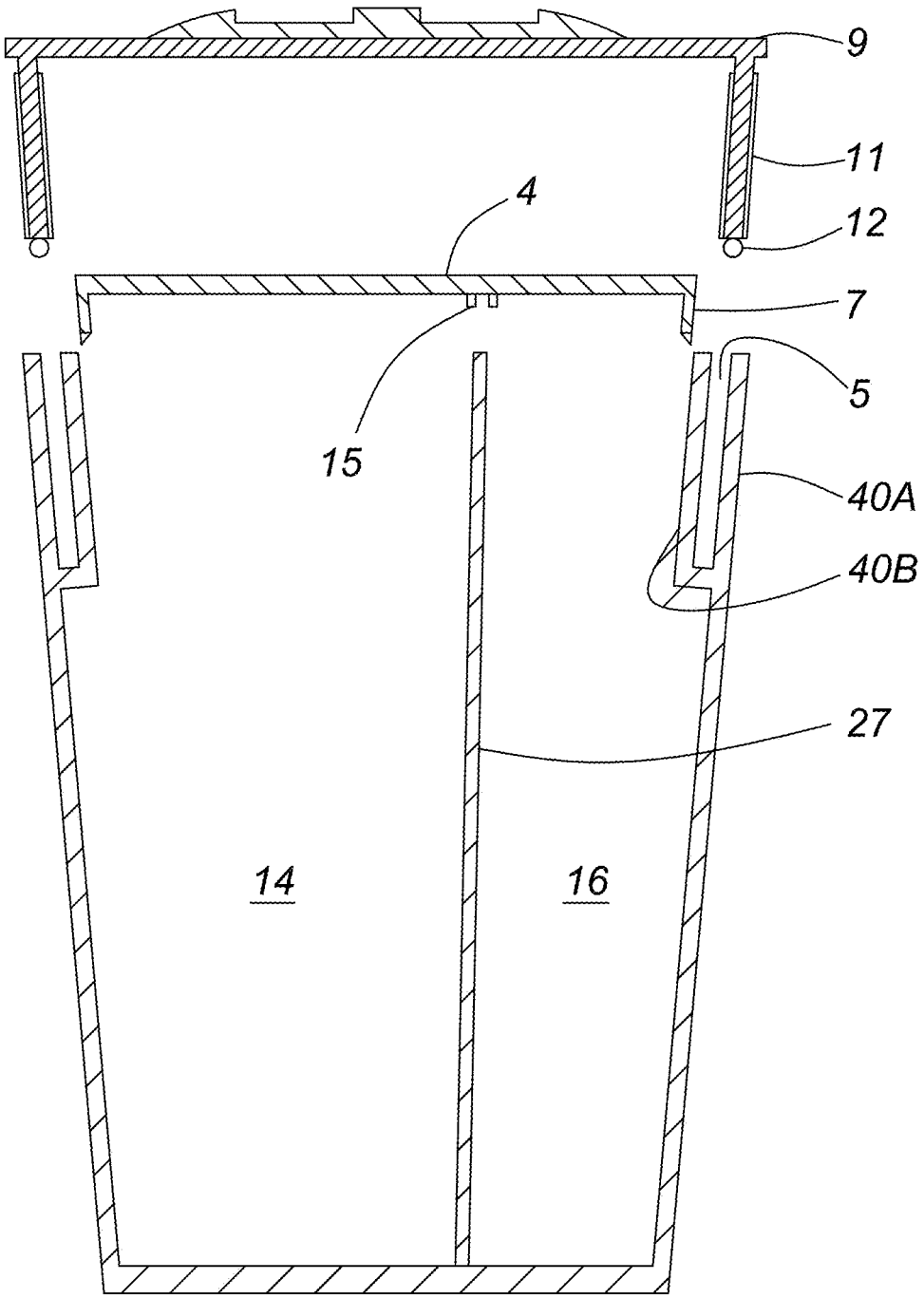
FIG. 5 is a cross-sectional view of the two-compartment pitcher taken along the line shown in FIG. 3.

FIG. 5 is a cross-section along the line shown at the top of the FIG. 3 and illustrates how the top cover 9 and lid 4 fit into the top open portion of pitcher body 1. As shown, the lid lip 7 of the lid 4 fits into the pitcher body 1 and forms a snug fit against the inner wall of the pitcher body 1. In addition, the ribs 15 on the underside of lid 4 engage and form a tight fit with the wall 27 that divides the pitcher body 1 into the first compartment 14 and the second compartment 16. As a result, the lid 4 forms a sealing barrier against leakage of liquid from one compartment to the next when liquid is being poured out of one of the spouts.

As further shown in FIG. 5, the flange 11 of the top cover 9 fits into groove 5 formed in the pitcher body 1. As mentioned, the groove 5 is defined by the outer wall 40A and the inner wall 40B at the top portion of pitcher body 1. The top cover flange 11 fits into the groove 5 and forms a snug fit to prevent or reduce any leakage of liquid as further shown in FIG. 6A. The outer surfaces of flange 11 may comprise an elastomeric material to provide a sealing engagement in groove 5 to prevent leakage of liquid.

The top cover 9 functions to allow the flow of liquid from one of the two spouts (13, 20) received from one of the compartments (14, 16), while blocking flow from the other when the pitcher is in use. As discussed below, various components in the pitcher 10 interact together to provide this function.

The inner wall 40B of the top portion of the pitcher body 1 has openings 27C and 27D located adjacent to first spout 20 and second spout 13, respectively (best shown in FIG. 3). In addition, the lid 4 has notched regions 27A and 27B (FIG. 3) formed in its lip 7 that respectively align with openings 27C and 27D when the lid is positioned over the opening of the pitcher 1. However, the top cover has only one opening 24 formed in the flange 11.

Figure 6B:
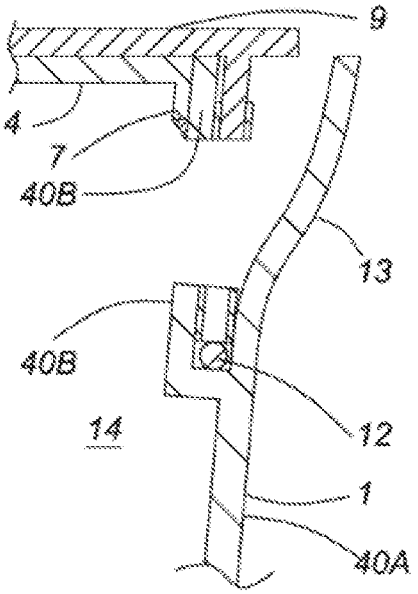
FIG. 6B is a partial cross sectional view of the pitcher of FIG. 1 in the region of a first spout in an open position.
Figure 6C:
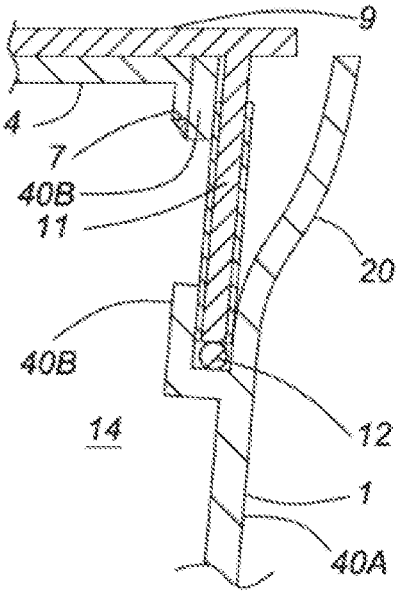
FIG. 6C is a partial cross sectional view of the pitcher of FIG. 1 in the region of a first spout in a closed position.
Figure 7:
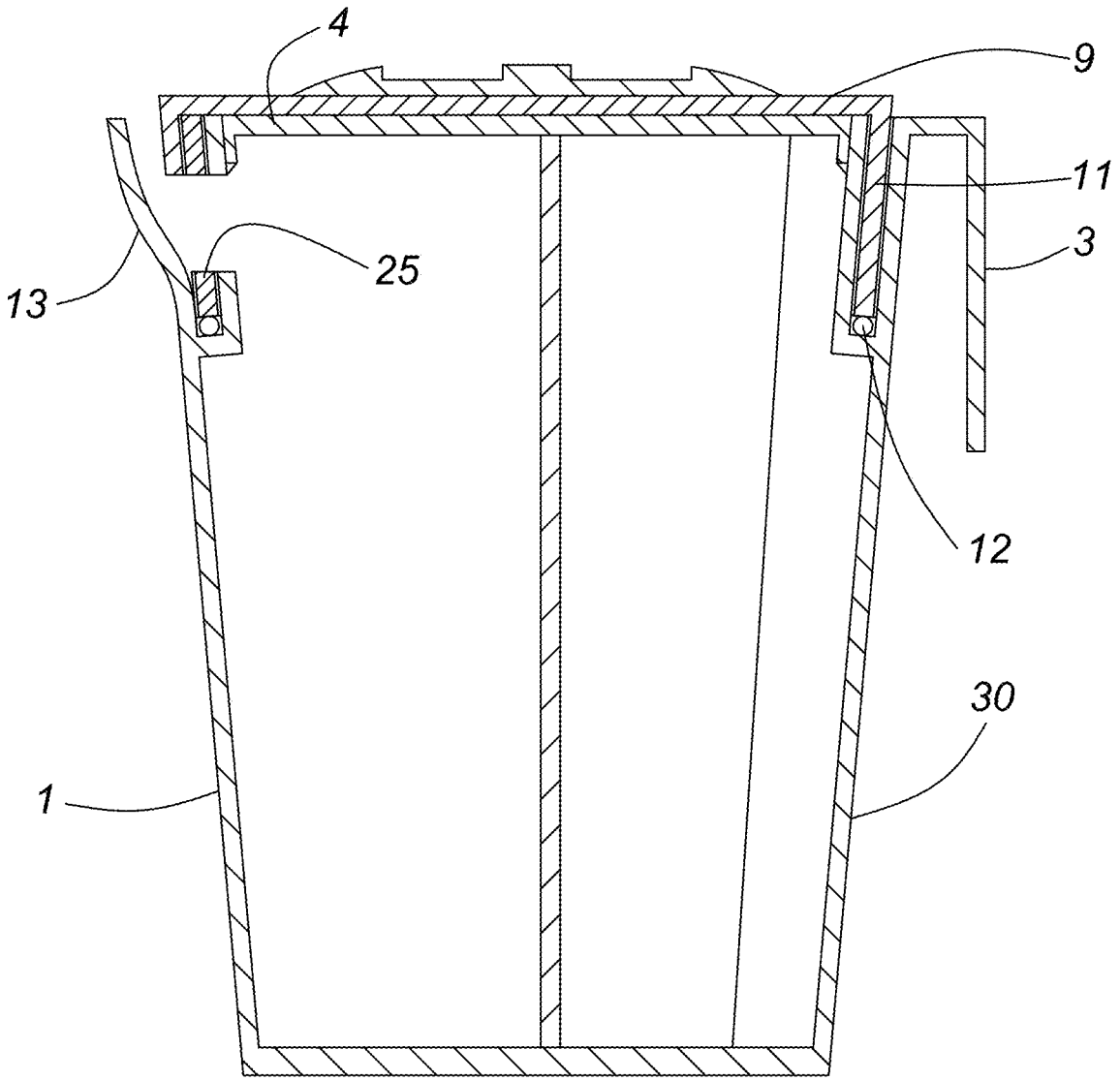
FIG. 7 is a full cross sectional view of the two-compartment pitcher of FIG. 1 along the line shown in the drawing.

The open position of first spout 13 is depicted in FIG. 7, which is a partial cross-section taken along the line in FIG. 1 when the first spout 13 is in the open position. FIG. 6B likewise shows a partial cross-section of the pitcher 10 in the region of the first spout in the same open position. With reference to FIG. 3, FIG. 6B and FIG. 7, the flange 11 is capable of rotating within the groove 5 and when the opening 24 of flange 11 is aligned with opening 27D in the inner wall 40B of the pitcher 10, liquid is able to flow from the first compartment 14 through aligned openings 27C and 24 and out through first spout 13. However, in this same position, the opening 26D in the pitcher inner wall 40B adjacent to the second spout 20 will be blocked by the flange 11 as shown in FIG. 6C. Likewise, when the flange 11 is rotated so that opening 24 in the flange 11 is aligned with opening 27D adjacent to the second spout 20, liquid can flow from the second compartment 16, through opening 27D in the pitcher inner wall 40B, through opening 24 in flange 11, and out through second spout 20. Likewise, in this position, opening 27C in the inner wall 40B adjacent to the first spout 13 will be blocked by flange 11. In this way, rotation of flange 11 formed in the top cover 9 within groove 5 can permit flow through one of the spouts and block flow through the other. Further, top cover 9 can be rotated within groove 5 to block both openings 27C and 27D. Blockage of both spouts 13 and 20 may be desirable during storage in a fridge to prevent leakage of liquid from the pitcher.

While the foregoing configuration can allow pouring of liquid from one spout, while blocking the other spout, as would be appreciated by those of skill in the art, other configurations can be utilized as well to facilitate open/closed positions as described, while avoiding leakage between compartments. In other words, the invention is not limited to the particular embodiments disclosed herein.

Moreover, although the pitcher is described above for dispensing two different liquids, one of the compartments instead can be used to hold ice and the other a liquid. In this way, the ice can serve to cool the liquid in the adjoining compartment. According to such embodiment, the thermal conductivity of the wall 27 is such that it facilitates the flow of heat from the liquid in one of the compartments to the ice in the adjoining compartment.

Flange 11 is most advantageously made of an elastomeric material to provide a snug fit between walls 40A and 40B that define groove 5, thereby preventing or reducing the leakage of liquid into the groove 5 during pouring of liquid from the pitcher body 1. Alternatively, flange 11 is made of a resilient plastics material that is coated with rubber or other elastomeric material that provides a seal between walls 40A and 40B that define the groove 5. However, the flange 11 is most advantageously constructed of a material that allows a sliding engagement within groove 5 to allow rotation between the open and closed positions described above.

In a further embodiment, the pitcher 10 is made of a material that is heat resistant so that the material does not melt in a dishwasher operating at a high temperature cycle.

Figure 8:
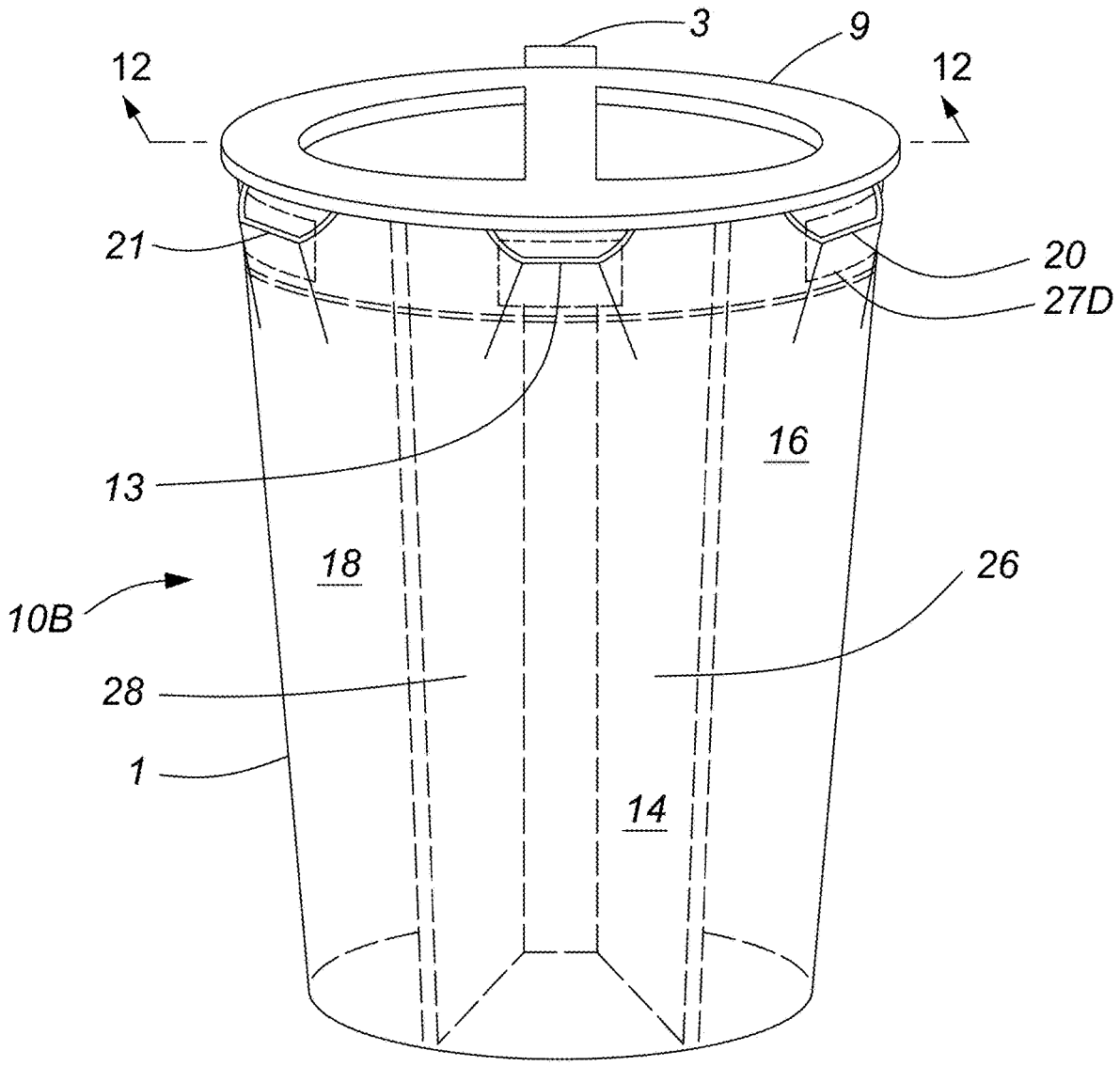
FIG. 8 is a three-dimensional drawing of a pitcher having three spouts and three respective compartments according to a second embodiment.

FIG. 8 shows a three compartment pitcher according to a second embodiment of the disclosure. Many of the components are similar to those described in connection with the two compartment pitcher 10 above. Accordingly, like reference numbers depict the same or similar components throughout the drawings.

In particular, FIG. 8 shows a pitcher 10B having three compartments: a first compartment 14 (middle), a second compartment 16 and a third compartment 18. The pitcher body 1 holds three liquids (alternatively two liquids and ice) in its respective compartments. Likewise, three spouts, namely first spout 13, second spout 20 and third spout 21 dispense liquid from respective compartments. The compartments 14, 16 and 18 are formed by a first wall 26, a second wall 28 and a third wall 30 within the pitcher body 1. The third wall 30 is obscured from view in FIG. 8 but can be visualized in FIGS. 9 and 10. Similar to the two-compartment pitcher 10, the three-compartment pitcher 10B has a top cover 9 and a handle 3 at 120 degrees from the second spout 20.

Figure 9:
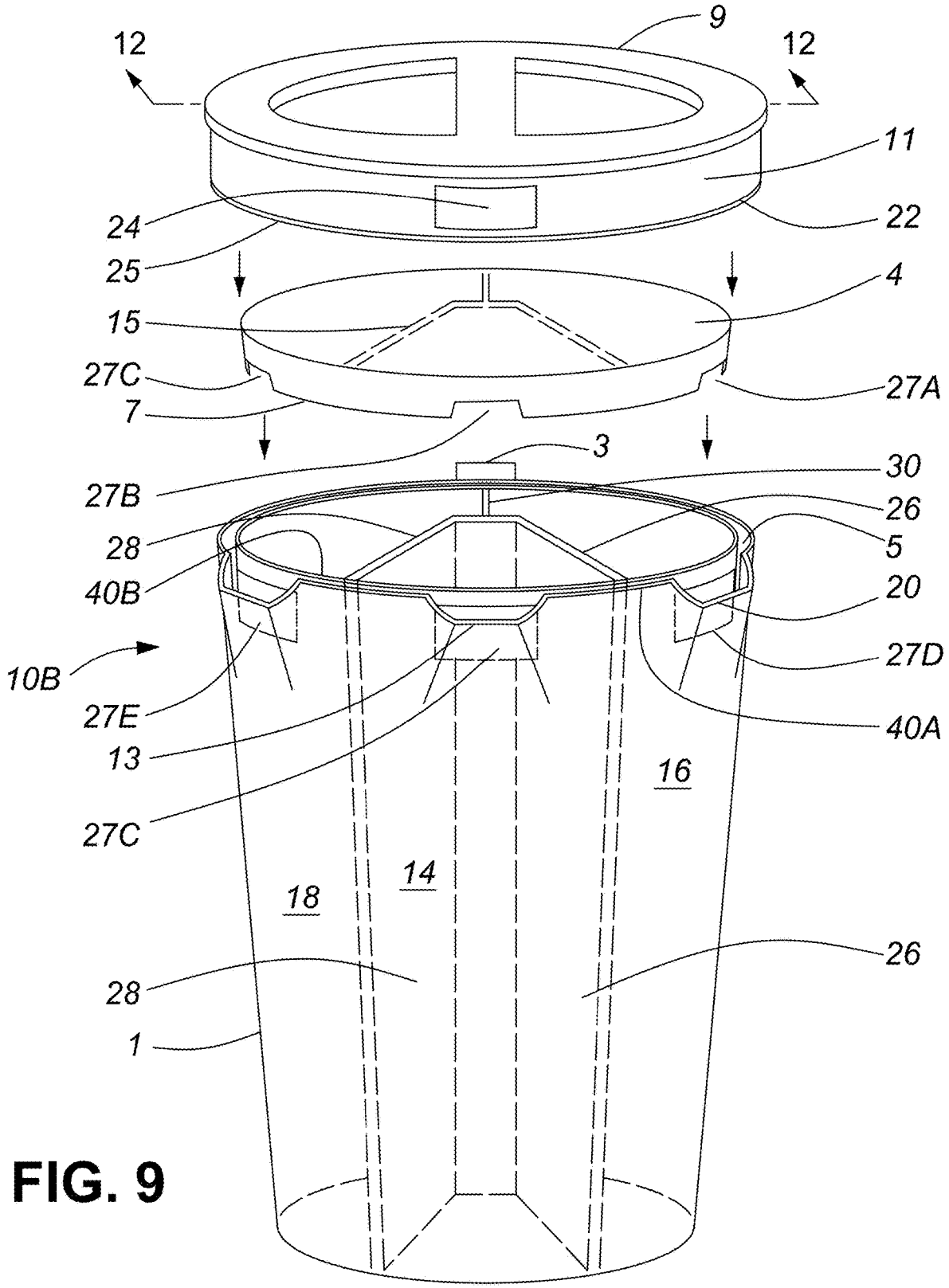
FIG. 9 is an exploded view of the three compartment pitcher, showing a top cover and a lid that fit on top of the pitcher opening as described herein.

FIG. 9 is an exploded view of the three-compartment pitcher 10B. The exploded view shows a top cover 9 that has a flange 11 and an opening 24 formed therein. The three-compartment pitcher 10B further comprises a lid 4 having a lid lip 7 with three notches 27A, 27B and 27C formed therein. The underside of lid 4 has ribs 15B configured to fit into the top portions of dividing walls 26, 28 and 30, preferably by a sealing engagement. Similar to the two-compartment pitcher 10, the three-compartment pitcher 10B has a groove 5 formed between inner and outer walls 40A and 40B (best shown in FIG. 12). Likewise, the inner wall 40A has formed therein three openings 27C, 27D and 27E adjacent to first spout 13, second spout 20 and third spout 21, respectively.

Figure 10:
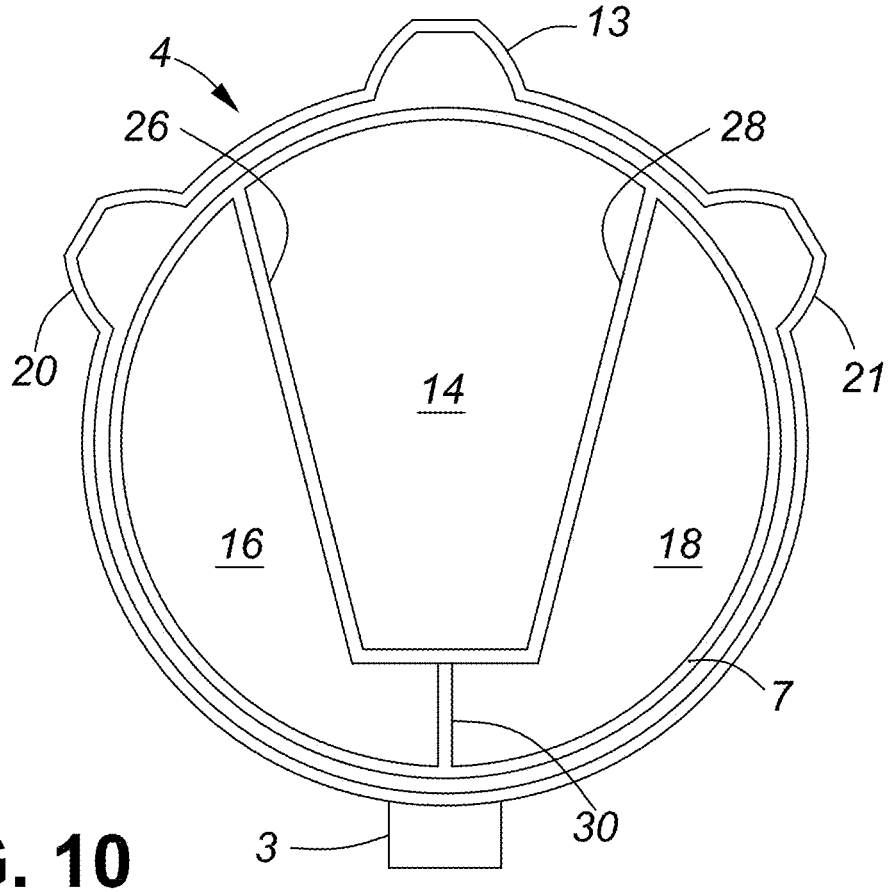
FIG. 10 is a top plan view of the three-compartment pitcher body.

FIG. 10 is a top plan view of pitcher body 1 of FIG. 9 and provides a better view of groove 5 and the three walls that divide the pitcher body 1 into the first, second and third compartments 14, 16 and 18. The first and second walls 26 and 28 generally form a U-shape and the third wall 30 lies in a plane perpendicular to the handle 3. Such a configuration is particular advantageous if the first compartment 14 is used to hold ice as the surface area between adjoining second and third compartments 16 and 18 is maximized in such configuration. However, it will be appreciated that other configurations are contemplated to fall within the scope of the disclosure as well.

Figure 11:
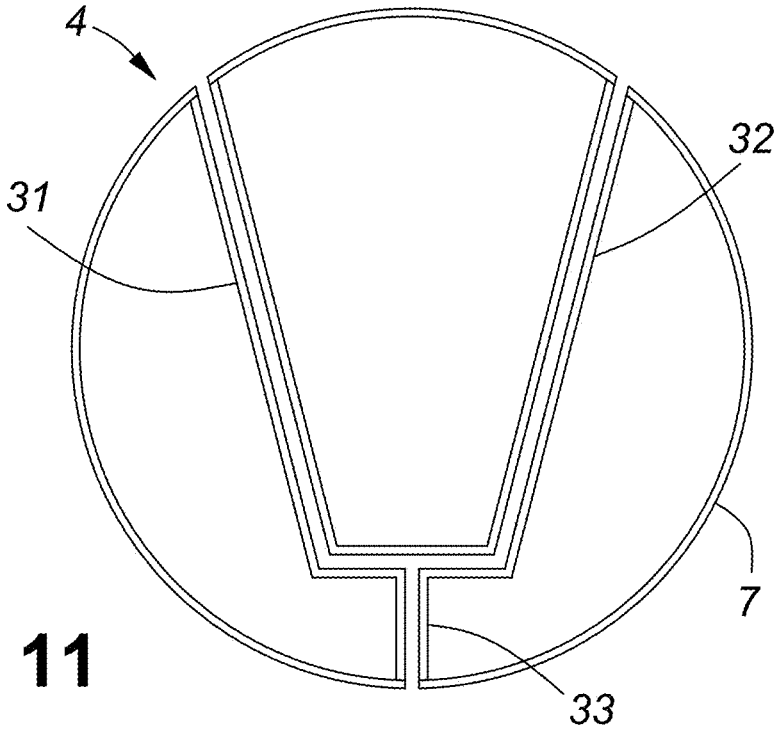
FIG. 11 is a bottom plan view of the lid for the three-compartment pitcher body.

FIG. 11 is a bottom plan view of the lid 4 that fits over the opening of the three compartment pitcher 10B. As can be seen, there are three sets of ribs, 31, 32 and 33 that fit into top portions of respective walls 26, 28 and 30 of the pitcher body 1.

Figure 12:
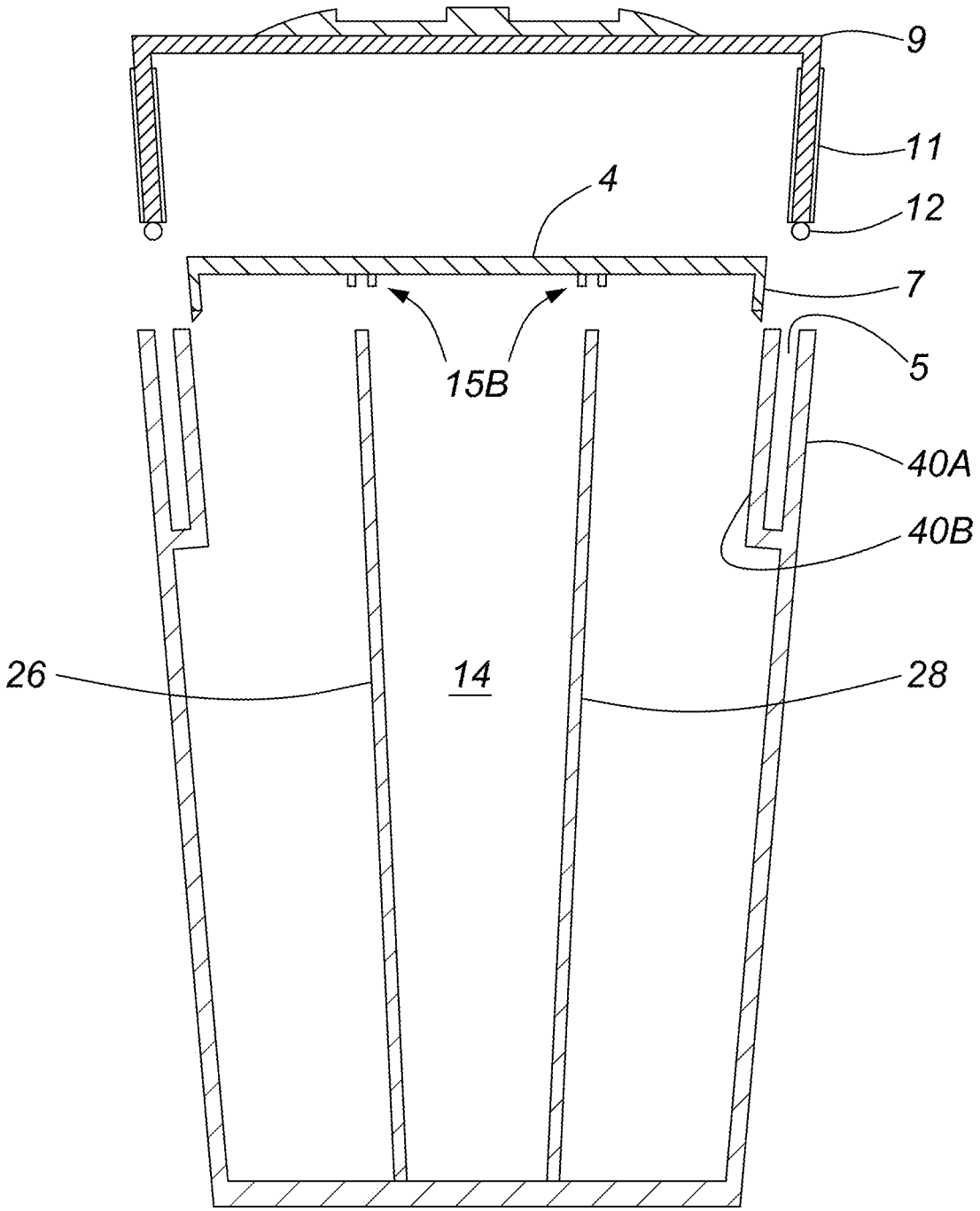
FIG. 12 is a cross-sectional view of the three-compartment pitcher taken along the line shown in FIG. 9.

As can be seen in FIG. 12, which is a cross-section taken along the line shown in FIG. 9, the lip of lid 4 abuts the side of inner wall 40A that defines groove 5 when the lid 4 is placed on top of the pitcher body 1. In addition, the ribs 15B formed on the underside of the lid 4 fit into upper portions of dividing walls 26 and 28. The flange 11 of top cover 4 fits into groove 5 formed between walls 40A and 40B. Opening and closing of spouts 13, 20 and 21 occurs by the same mechanism as described above in reference to the two-compartment pitcher 10. For example, if first spout 13 is in an open position, the opening 24 in flange 11 is aligned with opening 27C. The open configuration is the same as that depicted in FIG. 6B described in connection with the two-compartment pitcher. However, in this embodiment, opening 27D adjacent to second spout 20 and opening 27E adjacent to third spout 21 will be blocked by flange 11. Likewise, if opening 24 in flange is aligned with opening 27D, openings 27C and opening 27E will be blocked; and if opening 24 in flange 11 is aligned with 27E, opening 27C and 27D will be blocked by rotating the flange counter-clockwise or clockwise. All three openings 27C, 27D and 27E can be blocked by flange 11 by rotating the top cover 9 so that opening 24 formed in flange 11 is not aligned with any of the openings in the inner wall 40A.

It will be appreciated that the openings formed in the flange 11 of top cover 9 can be modified as required by those of skill in the art. For example, the openings can include means for preventing ice from flowing from the pitcher body into a glass or cup during pouring. Such means may include a plurality of parallel elongate bars or a grating formed in the openings. Moreover, more than one opening may be formed in the flange 11. For example, one opening may comprise a grating and the other may be free of such gratings. Other design modifications to the opening and openings formed in the flange 11 are included within the scope of the disclosure as well.

Figure 13:
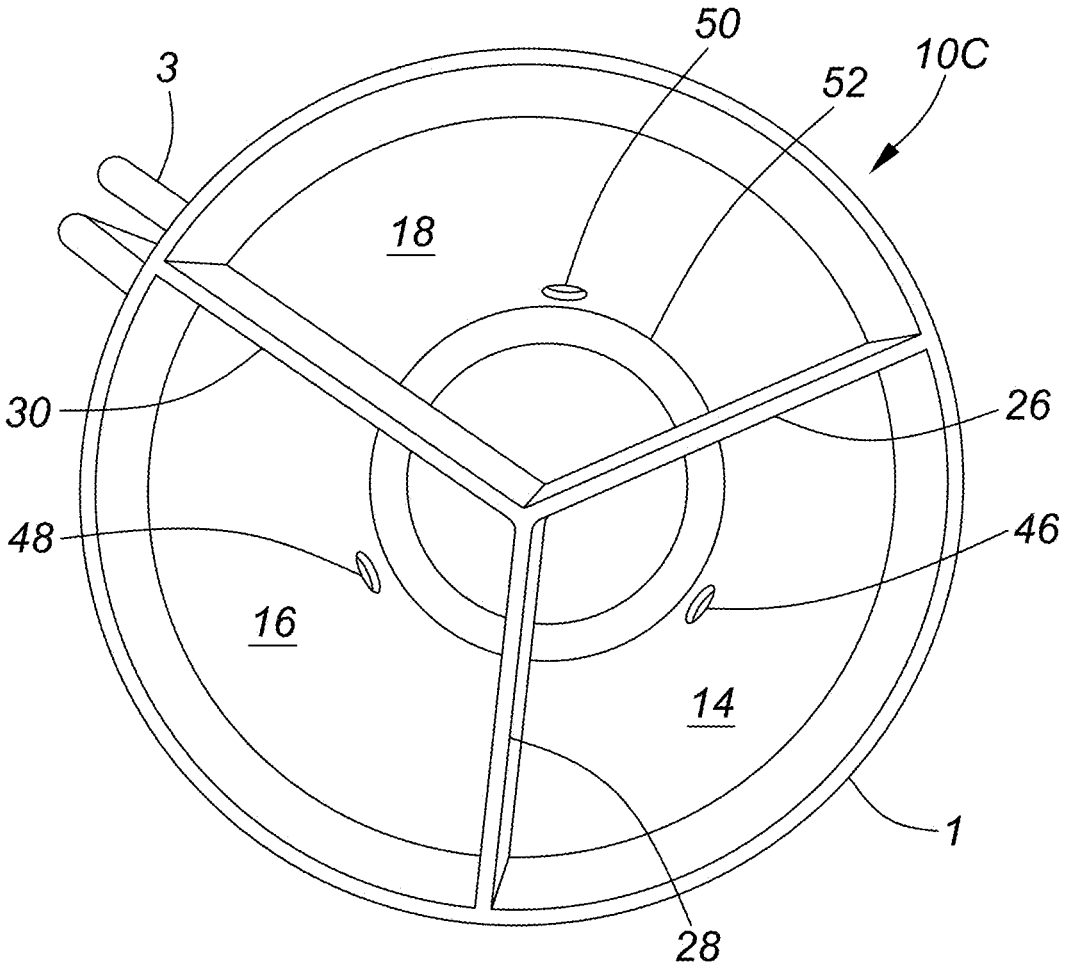
FIG. 13 is a top plan view of a three-compartment pitcher comprising openings for downspouts in a bottom portion of each compartment.

FIG. 13 shows an alternative embodiment of a pitcher 10C in which liquid is dispensed through the bottom portion of the pitcher body 1 through downspouts. Similar to the above embodiment, the pitcher 10C depicted in FIG. 13 has three compartments: a first compartment 14 (middle), a second compartment 16 and a third compartment 18. However, in this embodiment, the pitcher 10C has three openings in the lower portion of the pitcher body 1 to receive a respective downspout, namely first opening 46, second opening 48 and third opening 50. The downspouts include, without limitation, faucets, taps or spigots, which dispense liquid from bottom portions of respective compartments 14, 16 and 18, as described below. Similar to previous embodiments, the three-compartment downspout pitcher 10C has a handle 3 formed on the pitcher body 1.

Figure 16:
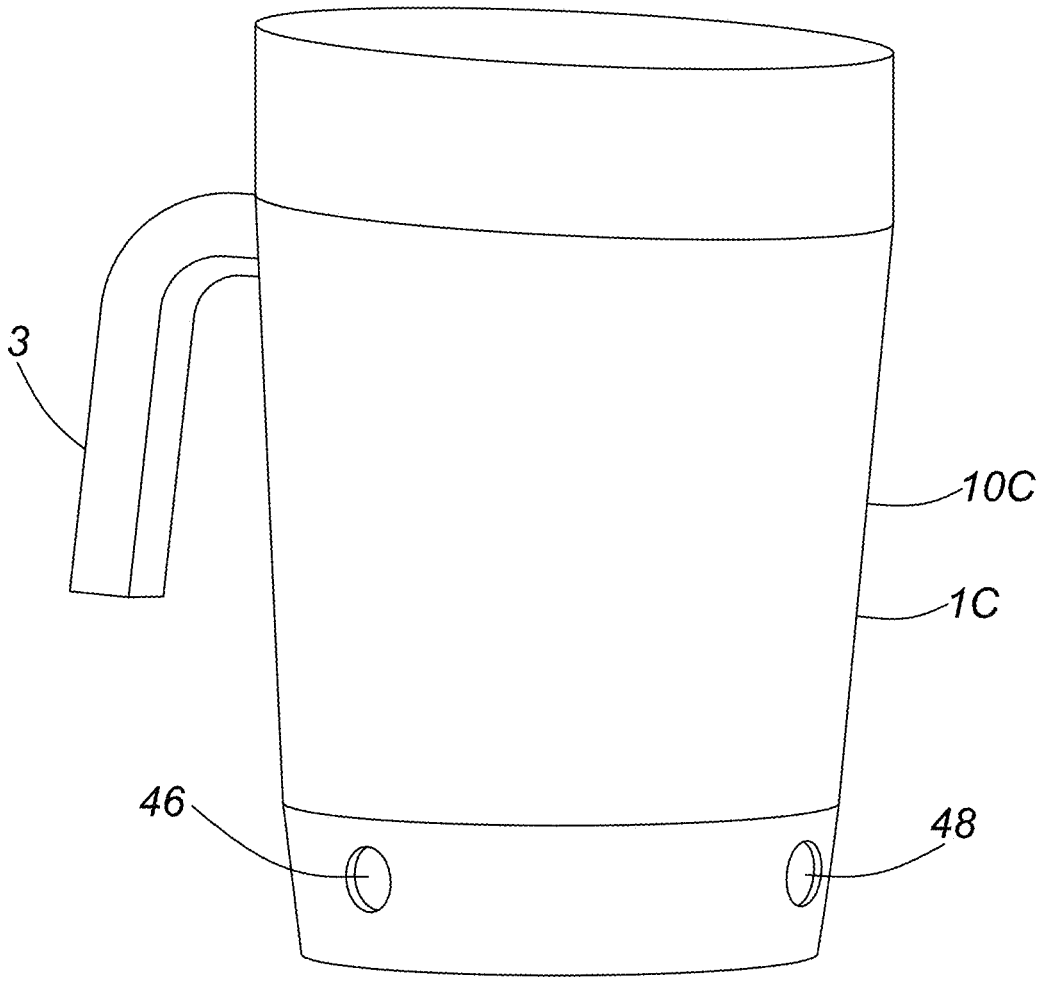
FIG. 16 is a 3D side elevation view of a pitcher showing openings in which respective downspouts can be mounted.

FIG. 16 is a side elevation view of the pitcher 10C showing the openings 46 and 48 in the side wall of the pitcher body.

Figure 14:
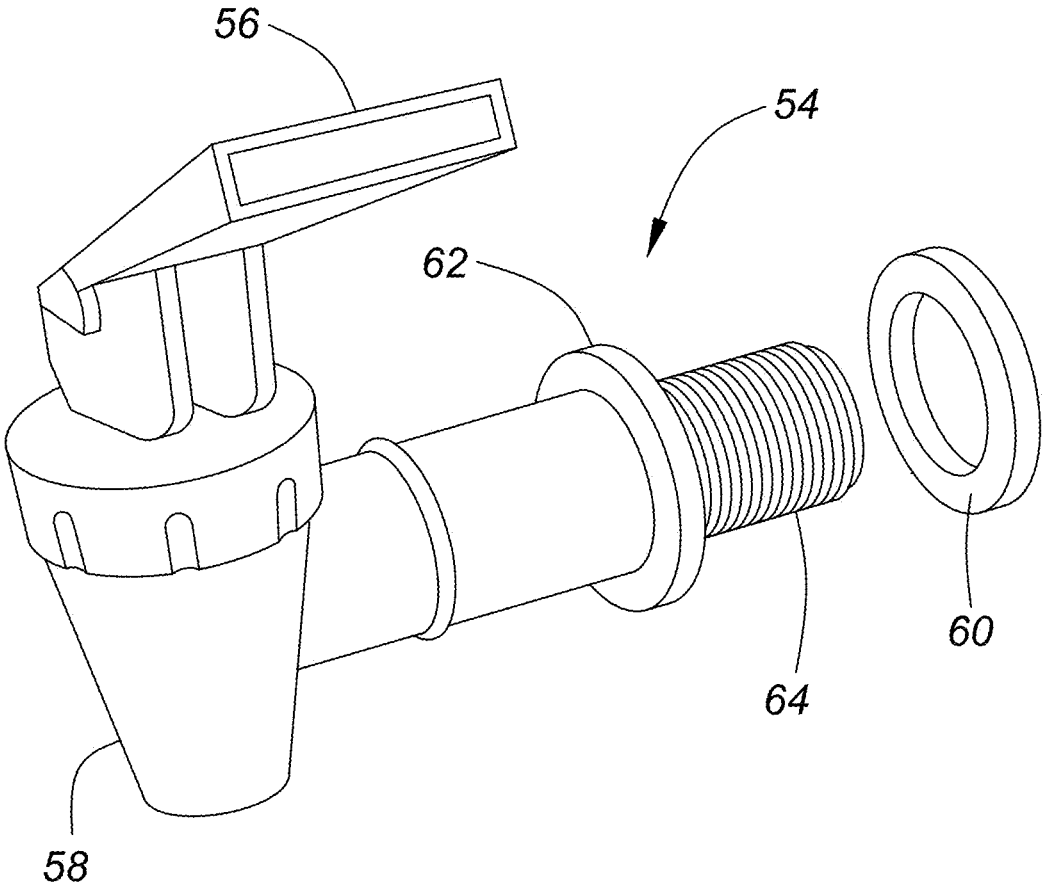
FIG. 14 shows an example of a downspout.

An example of a downspout 54 comprising a depressible lever 56 is shown in FIG. 14. The downspout 54 depicted comprises a threaded portion 64 for insertion into a respective opening in an outer wall of the pitcher body 1. A flange 62 abuts the outer wall of the pitcher body 1. A discharge end 58 provides a conduit for discharge of liquid when the lever 56 is actuated in an open position by a user. A washer 60 fits around the threaded portion 64 and is flanked by flange 62 and the outer wall 1C (see FIG. 15) of the pitcher body when mounted on the pitcher 10C. The levered downspout 54 comprises a valve system that discharges liquid when actuated. Valves of this type are generally known to those of skill in the art and thus the internal mechanism of the downspout 54 is omitted for brevity.

Figure 15:
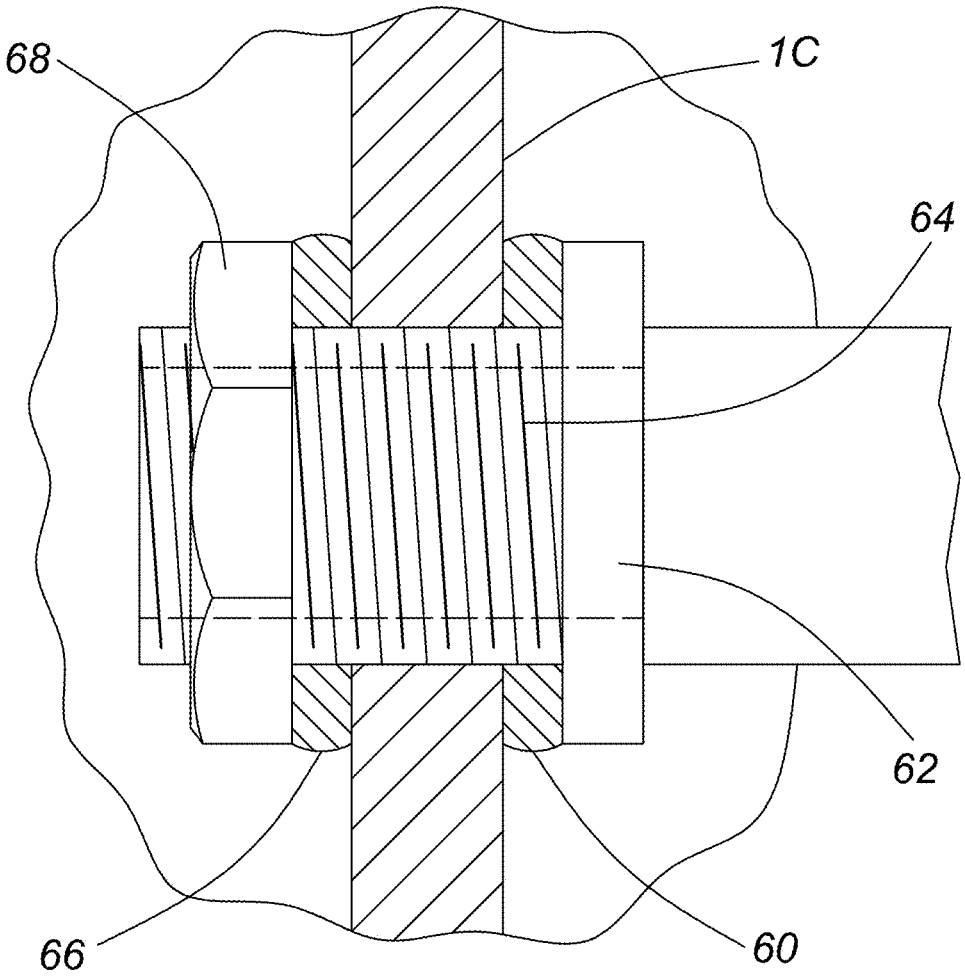
FIG. 15 depicts components used to secure the downspout to the outer wall of the pitcher.

FIG. 15 shows a partial cross-sectional side view of the downspout 54 mounted on the outer wall 1C of the pitcher body 1. Washers 60 and 66 flank the outer wall 1C of the pitcher and provide a sealing fit around the threaded portion 64. A hexagonal nut 68 secures the downspout 54 in place on the threaded portion 64 via a threaded engagement. When tightened, nut 68 depresses the washers 60 and 66 against respective opposing sides of the side wall 1C to prevent leakage of liquid.

While a levered downspout is shown in the drawings, any type of spout that is actuated by a user between an open and closed position can be used in the practice of the disclosure, including those with or without valves.

Figure 17A:
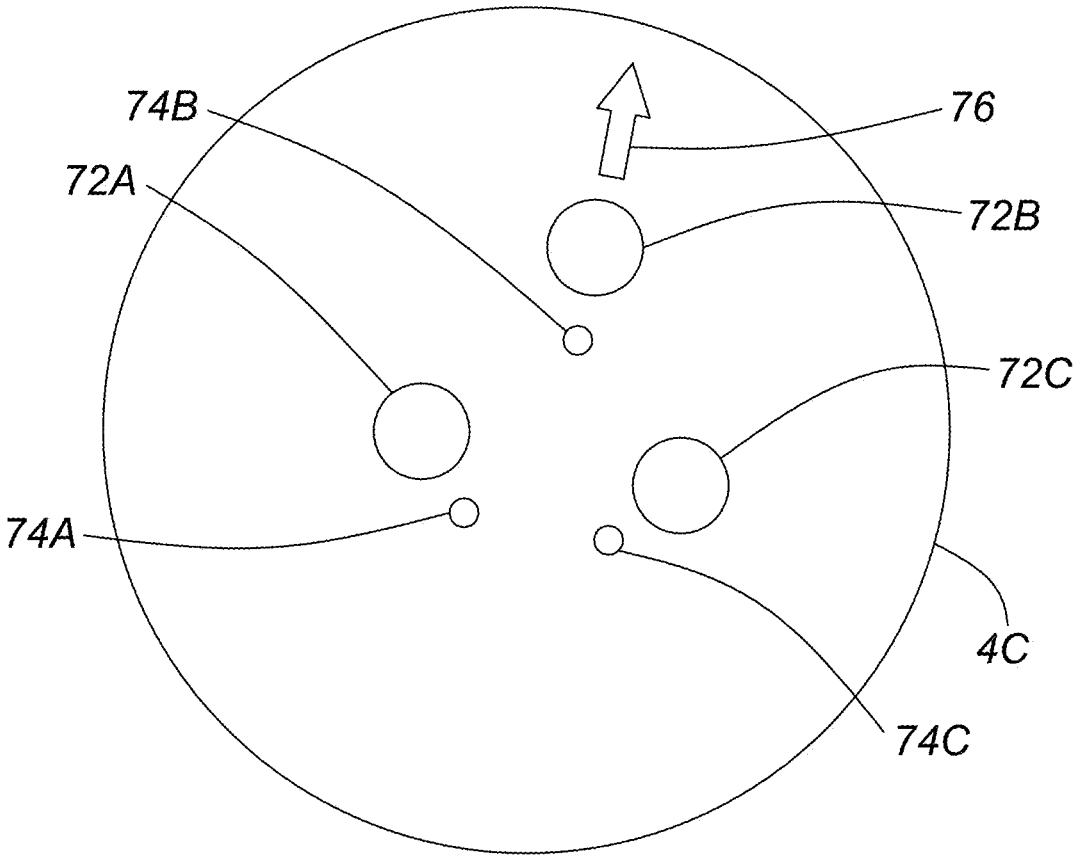
FIG. 17A shows a plan view of a lid when mounted on the top opening of a pitcher comprising downspouts.

FIG. 17A shows a top surface of lid 4C when mounted on pitcher 10C. The lid 4C has depressions 72A, 72B and 72C formed therein and sized so a user can insert three of his or her fingertips/thumb in the depressions to grasp and remove the lid 4C from the pitcher body 1. However, a handle or other alternate structure for grasping and removing the lid 4C is included within the scope of the disclosure. The lid 4C also comprises an embossed arrow 76 to aid in alignment of ribs on the underside of lid 4C over internal walls as described below. Other alignment indicia could be used as would be apparent to those of skill in the art.

Notably, the lid 4C also has openings 74A, 74B and 74C for venting air as further shown in FIG. 17A. Each opening 74A, 74B and 74C communicates with a respective compartment formed in the pitcher body 1 (see FIG. 13). The provision of such venting function is advantageous as it facilitates venting of air individually from each compartment and discharge of liquid through a respective downspout when opened by a user. Without such venting, the liquid contents of the pitcher compartments would discharge slowly or not at all. The openings may include a passageway in a structure such as a flip top pour spout formed within or on the lid.

Figure 17B:
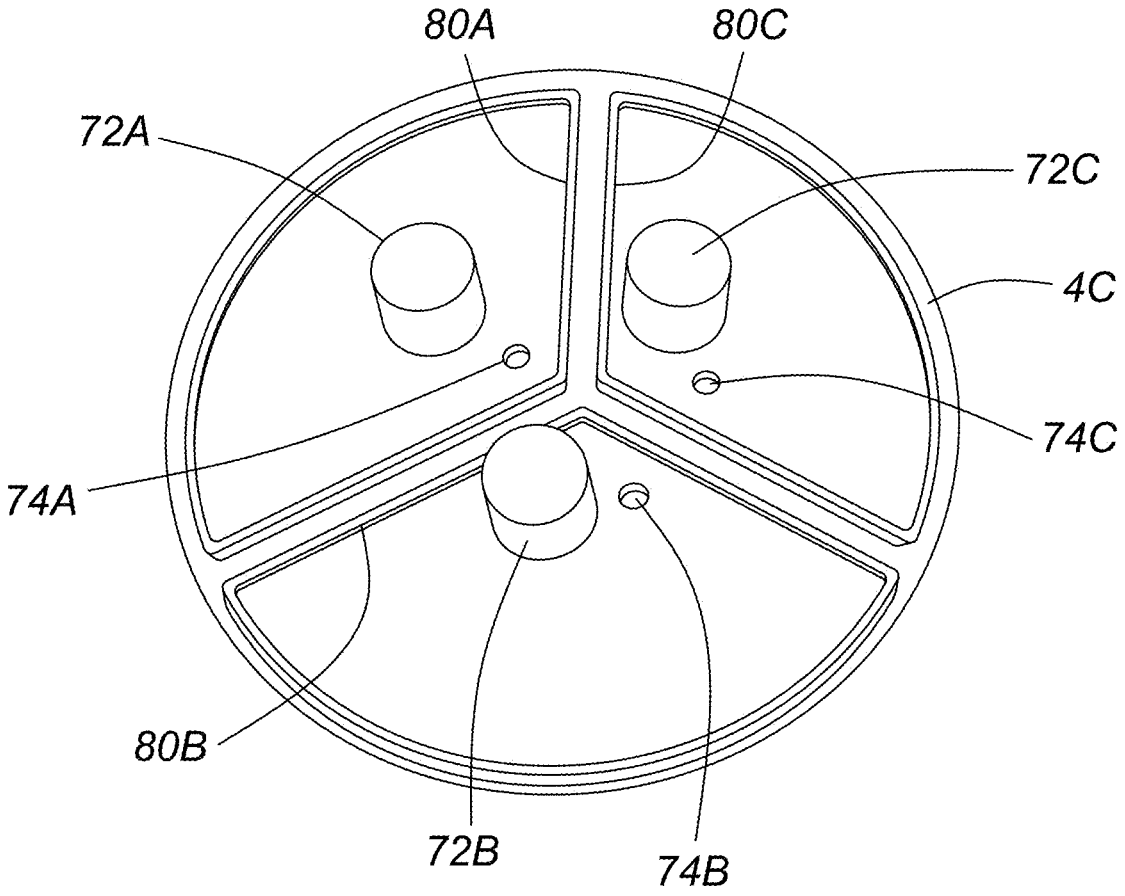
FIG. 17B shows a plan view of the underside of a lid for a pitcher comprising downspouts.

FIG. 17B depicts the underside of lid 4C. As shown, a series of ribs 80A, 80B and 80C are arranged to engage the inner walls that enclose each compartment 14, 16 and 18.

The dimensions of the compartments of pitcher should be large enough to accommodate a volume of juice prepared from a frozen can. For example, one can of frozen juice typically requires three cans of water to produce the final juice product. The final volume of 4 cans of liquid is typically 1.42 L or 1,420 mL. According to one embodiment, each compartment has the capacity to hold at least 1,200 mL of liquid, 1,300 mL of liquid or most preferably 1,400 mL of liquid. For a two-compartment pitcher, the total volumetric capacity of the pitcher may be about 2.84 L or 2840 mL. For a three-compartment pitcher, the total volumetric capacity of the pitcher may be about 4.26 L or 4260 mL. However, the volumetric capacities of the compartments can be modified as required.

It will be understood that those skilled in the art will readily recognize various adaptations and variations of the embodiments described above. Such adaptations and variations fall within the scope of the present disclosure as defined in the claims that follow.

What is claimed is:

1. A multiple-compartment pitcher having three or more compartments comprising:

a pitcher body for containing and dispensing three or more different liquids, the pitcher body having a base, an external surrounding side wall extending upwardly from and surrounding the base, and a top opening defined by the external surrounding side wall, the external surrounding side wall being circular in cross-section;

a single non-movable handle formed integrally and longitudinally on one side of the pitcher body on the external surrounding side wall thereof;

the pitcher body comprising internal dividing walls to form at least three internal compartments of equal size and dimensions to one another within the pitcher body;

the external surrounding wall comprising openings formed in the bottom portion thereof, each opening fluidly communicating with a respective one of said at least three internal compartments;

the internal walls comprised of at least three walls, the walls being planar and converging at a central point in the pitcher body, each of the internal compartments defined by the external surrounding side wall of the body and two of the internal walls and each of the internal compartments being pie-shaped in transverse cross-section;

each of the internal compartments receiving a downspout that is a faucet, spigot or a tap projecting outwardly from the external wall for dispensing liquid from a respective compartment, the faucet, spigot or tap being actuated by a user to dispense liquid from a respective one of the at least three internal compartments of the pitcher when said pitcher is in use;

the single, non-movable handle formed on the external side wall of the pitcher body;

wherein each opening that receives a respective one of a downspout is located at a vertical location on the side wall of the pitcher body so the pitcher can stand upright when the downspouts are mounted thereon;

wherein a transverse cross-sectional area of the pitcher body increases from the base to the top opening of the pitcher body;

a lid for placement over the top opening of the pitcher body, the lid having openings, each opening being in fluid communication with a respective one of the internal compartments to allow for flow of air therefrom, independently from another one of the other internal compartments, when a respective one of the downspouts is actuated in an open position when the pitcher is in use.

2. The multiple-compartment pitcher having three or more compartments of claim 1, wherein the lid has ribs on an underside thereof for engaging the top portion or portions of the one or more internal walls to provide a sealing fit therewith.

3. The multiple-compartment pitcher having three or more compartments of claim 1, wherein the lid comprises depressions for enabling grasping and removal of the lid from the top opening of the pitcher body.

4. A multiple-compartment pitcher comprising:

a pitcher body for containing and dispensing two or more different liquids, the pitcher body having a top opening;

a handle formed on the pitcher body;

the pitcher body comprising one or more internal walls to form at least a first compartment and a second compartment within the pitcher body and wherein the pitcher body optionally comprises a third compartment formed by said walls;

a lid for placement over the top opening of the pitcher, the lid having a pair of ribs for engaging the top portion or portions of the one or more internal walls to provide a sealing fit therewith;

first and second spouts respectively formed in the first and second compartments, and optionally a third spout is formed in a respective third compartment, wherein, when the pitcher is in use, liquid is capable of flowing out of the pitcher from one of the compartments via a respective spout when in an open position;

wherein the first and second spouts and optional third spout are each at a position in the pitcher body of at least about 110 degrees as measured from the handle; and a top cover for placement over the lid, the top cover having an opening formed therein for alignment with one of the spouts when in the open position and wherein the top cover provides a barrier over the spout when in a closed position; and a groove being formed in a top portion of the pitcher body by inner and outer walls formed in the pitcher body for receiving a flange of the top cover and wherein an opening in the flange is aligned with a corresponding opening formed the inner wall of the pitcher body adjacent to a spout when in said open position and wherein the flange blocks the opening formed in the inner wall in said closed position.

5. The pitcher of claim 4, wherein the flange is made of, or comprises on its external surface, an elastomeric material that provides a sealing fit between the outer and inner walls that form the groove when the flange is inserted in the groove.

6. The pitcher of claim 4, wherein the first compartment, the second compartment and the optional third compartment are each sized to accommodate 1,200 mL of liquid.

7. The pitcher of claim 4, wherein the first compartment, the second compartment and the optional third compartment are each sized to accommodate 1,400 mL of liquid.

8. The pitcher of claim 4, wherein the pitcher is constructed from a material that is thermo-resistant to withstand temperatures during a cleaning at a high temperature cycle of a dishwasher.

9. The pitcher of claim 4, wherein the one or more internal walls are made of a material that has a thermal conductivity that facilitates the flow of heat from a liquid contained in one compartment to ice contained in another compartment when the pitcher is in use.

10. The pitcher of claim 9, wherein the internal barriers form three compartments in the pitcher body and wherein a central compartment has walls adjoining two of the three compartments, the walls of the central compartment having a thermal conductivity that facilitates the flow of heat from liquid in the other two compartments to the central compartment when the central compartment holds ice and the adjoining two compartments each hold a liquid.

11. The pitcher of claim 4, wherein the first and second spouts and optional third spout are each at a position in the pitcher body of at least about 115 degrees as measured from the handle.

* * * * *